United States Patent [19]

Hebert

[11] Patent Number: 4,526,278

[45] Date of Patent: Jul. 2, 1985

[54] BOARD ROAD BUNDLE CRADLE

[75] Inventor: Francis A. Hebert, Shriever, La.

[73] Assignee: South Louisiana Contractors Inc., Lafayette, La.

[21] Appl. No.: 503,893

[22] Filed: Jun. 13, 1983

[51] Int. Cl.[3] ..... B66C 23/06

[52] U.S. Cl. ..... 212/242; 212/244; 212/259; 414/685

[58] Field of Search ..... 212/147, 148, 220, 221, 212/242-244, 251, 259, 125, 135; 414/685, 687, 694, 721, 722, 745, 785

[56] References Cited

U.S. PATENT DOCUMENTS

| | | | |
|---|---|---|---|
| 70,514 | 11/1867 | Brown . | |
| 132,801 | 11/1872 | Chinnock . | |
| 152,299 | 6/1874 | McCauley . | |
| 174,659 | 3/1876 | Brisley . | |
| 2,335,556 | 11/1943 | Wilson | 94/13 |
| 2,382,789 | 8/1945 | Guignon | 94/13 |
| 2,639,650 | 5/1953 | Robishaw | 94/13 |
| 2,646,893 | 7/1953 | Weatherford | 212/242 |
| 2,652,753 | 9/1953 | Smith | 94/13 |
| 2,912,180 | 11/1959 | Lindberg | 212/135 |
| 2,912,909 | 11/1959 | Hart | 94/13 |
| 3,043,444 | 7/1962 | Melton | 212/147 |
| 3,909,996 | 10/1975 | Ettlinger | 52/177 |
| 3,963,130 | 6/1976 | Maynard | 414/785 |
| 4,129,223 | 12/1978 | Probst | 414/785 |
| 4,289,420 | 9/1981 | Davis et al. | 404/35 |
| 4,365,926 | 12/1982 | Brown | 212/259 |

FOREIGN PATENT DOCUMENTS

| | | | |
|---|---|---|---|
| 2038279 | 7/1980 | United Kingdom | 414/785 |

*Primary Examiner*—Sherman D. Basinger
*Assistant Examiner*—Stephen P. Avila
*Attorney, Agent, or Firm*—Wilkinson, Mawhinney & Theibault

[57] ABSTRACT

The present disclosure of a board bundle cradle is for use with the free end of a dip stick having a pivoted work carrier at its free end having a hook which has a horizontally rotatable work carrier movable through an arc of the order of 106° horizontally relative to the pivot. The board road board bundle cradle has a pair of spaced apart end frames each of which has a base member adapted to receive and support a bundle of boards to be laid into a board road. A major and a minor board bundle containment member upstands from each end of each base member and extends from the upper portion of each major support member. Spacer means between the spaced apart end frames rigidly secures the frames together. The portion lying between the upwardly forwardly inclined member and the upper free end of the minor board bundle containment member defines the loading mouth of the cradle through which a bundle of boards to be laid are introduced to the base members of each end frame. The cradle is carried by the hook on the horizontally rotatable work carrier and is engagable with the spacer at the upwardly forwardly inclined member of each end frame to rotate the cradle containing a board bundle alternately ninety degrees for presenting the boards for laying both longitudinally and transversely of the direction of the board road to be laid.

1 Claim, 6 Drawing Figures

BOARD ROAD BUNDLE CRADLE

TECHNICAL FIELD

My invention relates to a board bundle cradle for positioning 50 board bundles of boards 5 boards wide and 10 board layers high alternately longitudinally and transversely of the major axis of the board road to be laid and advancing the board bundle along the road as it is being laid so that the road builders do not have to keep walking back to the board bundle drop site. With this cradle the board bundle is right up with the builder as the construction proceeds and much of the walking between the board drop site and the actual point of construction has been eliminated.

BACKGROUND ART

The laying of a board road has for at least the past 40 years been a manual task as has been the taking up thereof. The road is laid by placing a first layer of boards with their major axis along the line of travel of the road in adjacent staggered abutting longitudinal relationship. A second layer of boards are laid on the first layer with their major axes at right angles to the first layer. A third layer of boards are laid over the second layer with their axes at a right angle to the second layer and two spaced apart groups of 5 or 6 boards spaced about 30 inches apart define the wheel travel surface for vehicles using the board road. The boards of this third or top layer are staggered in abutting longitudinal relationship transversely and are nailed to the second layer about 5 nails per 16 ft. board to stabilize the travel surface. This board road may be 50 ft. to 5 miles in length.

The road described above is a 3 ply road; however, depending upon the compaction of the ground over which it is layed and the gross weight of the vehicles traveling thereover the road may be six or nine ply which only require adding additional layers as described above.

Preparatory to commencing construction bailed 50 board bundles are dropped at the construction site or spaced along the construction site where the workmen must walk back and forth between the bundles and the boards laid forming the road resulting in much lost time.

Other than the manual laying of a board road described above the only method and apparatus for laying board roads known to me are the following U.S. Pat. Nos.:

| | | | | | |
|---|---|---|---|---|---|
| 70,514 | Brown | 1867 | 2,382,789 | Guignon | 1945 |
| 132,801 | Chinnock | 1872 | 2,639,650 | Robishaw | 1953 |
| 152,299 | McCauley | 1874 | 2,652,753 | Smith | 1953 |
| 174,659 | Brisley | 1876 | 2,912,909 | Hart | 1959 |
| 2,335,556 | Wilson | 1943 | 3,909,996 | Ettlinger | 1975 |
| | | | 4,289,420 | Davis et al | 1981 |

DISCLOSURE OF THE INVENTION

A board road is laid by grasping the boards from a stack carried by the cradle of the present invention which permits boards to be withdrawn from the cradle alternately longitudinally and transversely of the axis of the board road being laid.

One form of apparatus for practicing my invention is for use with a self-propelled crawler unit of the type illustrated in my co-pending application Ser. No. 318,821, filed Nov. 6, 1981 having a horizontally traversable rotary top side works capable of rotating at least 180° with an elevatable dip stick on the free end of which the grab has been replaced by the board bundle cradle of the present invention mounted on a horizontally rotatable support having a cradle hook which is rotatable through at least 105° relative to the dip stick. The cradle is hooked on the free end of the dip stick of the crawler unit with the frame to move the cradle carrying a bundle of boards over the board road under construction.

The cradle may be rotated to present the boards for grasping and removal by the workers either transversely or longitudinally of the road as construction progress dictates. Board bundles are introduced to the cradle through its mouth and the top side works can be rotated 180° to permit the hook carried by the dip stick to pick up the cradle and swing it 180° horizontally to where the men laying the board road may grasp and remove the boards.

PREFERRED EMBODIMENT OF THE INVENTION

A board road is laid by first placing the bottom layer of boards on the ground with their major axis longitudinally along the major axis or direction of travel of the road. The second layer of boards are laid over the first layer with their axes transversely of the bottom longitudinal layer. The third or top layer defining the vehicle treadways are laid over the second layer and all three layers are joined by fastening the boards together using 50 penny nails $5\frac{1}{2}''$ long, one nail about every three feet along only the top layer of longitudinally disposed boards.

The boards being $2'' \times 8''$ and 16 feet long are brought to the road site in bailed bundles of 50 boards, 5 boards wide and 10 layers high.

It will be appreciated that boards will have to be laid both longitudinally and transversely so that it would be expeditious to be able to alternately place the board bundle longitudinally and transversely of the roadway and to keep up with the placement of the boards on the ground.

The board bundle cradle of the present invention has been built to accommodate a bundle of boards and to be hung on the free end of a dip stick having a pivoted work carrier at its free end which work carrier has a horizontally rotatable work carrier movable through an arc of the order of 106° horizontally relative to the pivot upon which the cradle is carried by hooking engagement therewith. The dip stick is mounted on a self-propelled crawler unit.

Figure 1:
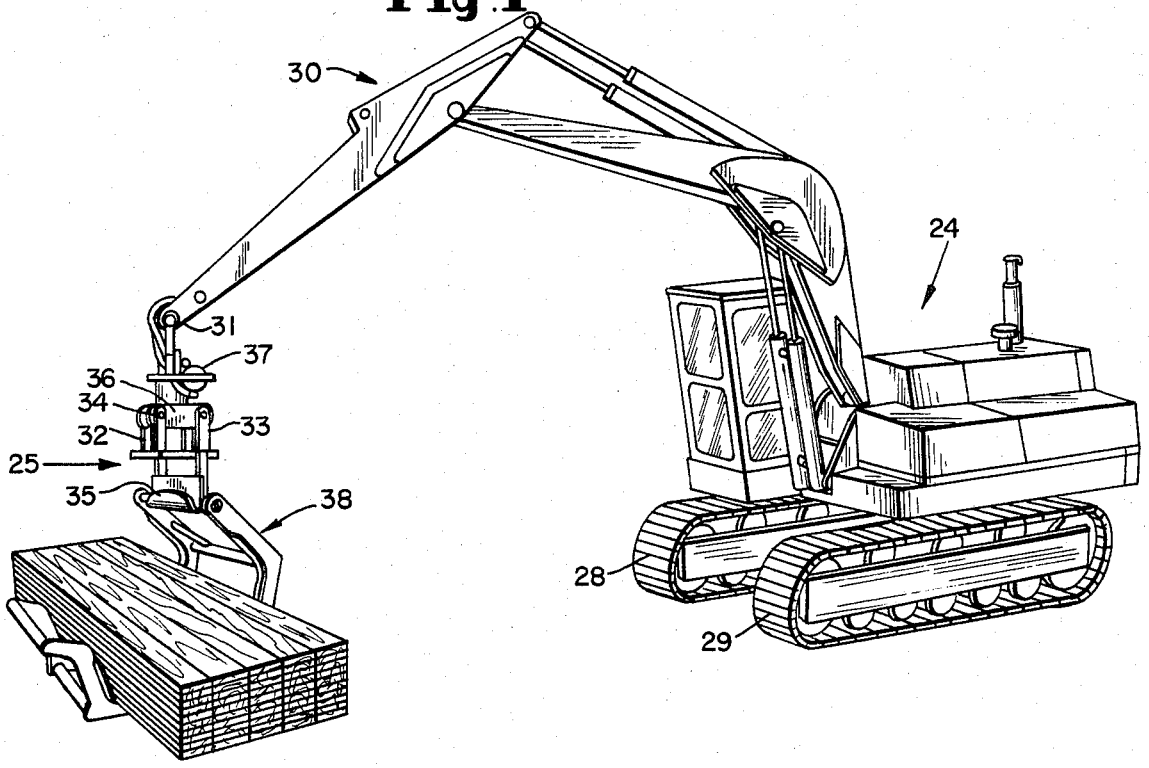
FIG. 1 is a perspective view of vehicle and attachments forming the hook and board road board cradle of the present invention.

Referring now to the drawings, a crawler unit 24 is shown with a horizontal work carrier 25. The crawler as shown is a self-propelled machine of the type manufactured by John Deere known as a JD690-B having two bottom endless propulsion tracks 28,29 on top of which is carried a top side works including an elevatable dip stick 30 to which the work carrier 25 is pivoted at 31. The top side works is horizontally rotatable relative to the propulsion tracks 28,29 through 360° so that as shown in FIG. 1 the dip stick 30 can be swung to the rear by rotating the top side either to the right or left.

Figure 2:
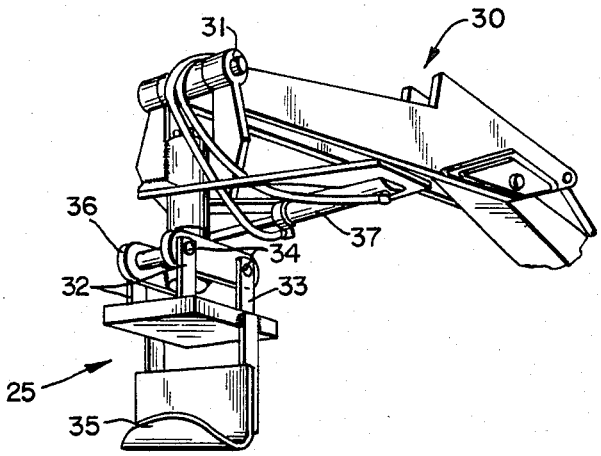
FIG. 2 is a fragmentary perspective view of the end portion of the dip stick having the board bundle cradle hook attachment of the present invention thereon.
Figure 3:
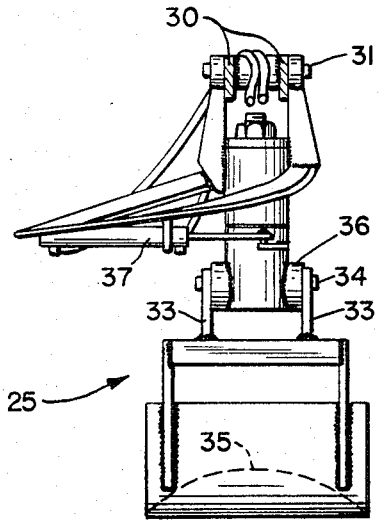
FIG. 3 is a rear elevational view of the board bundle cradle hook of FIG. 2.
Figure 5:
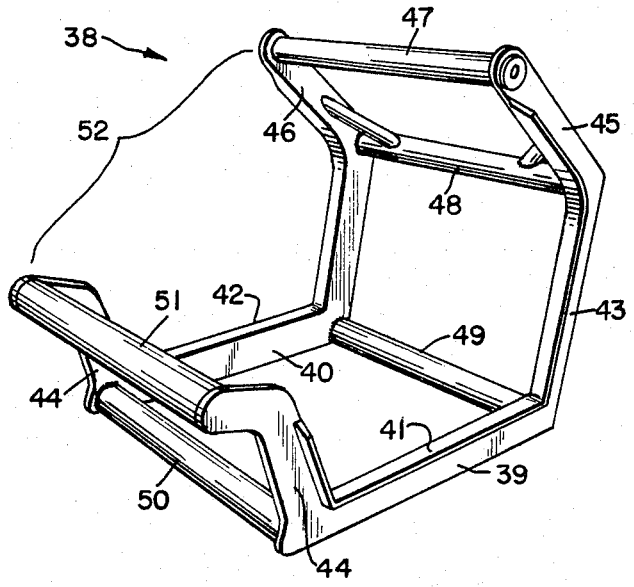
FIG. 5 is a perspective view of the board bundle cradle of FIG. 4.
Figure 4:
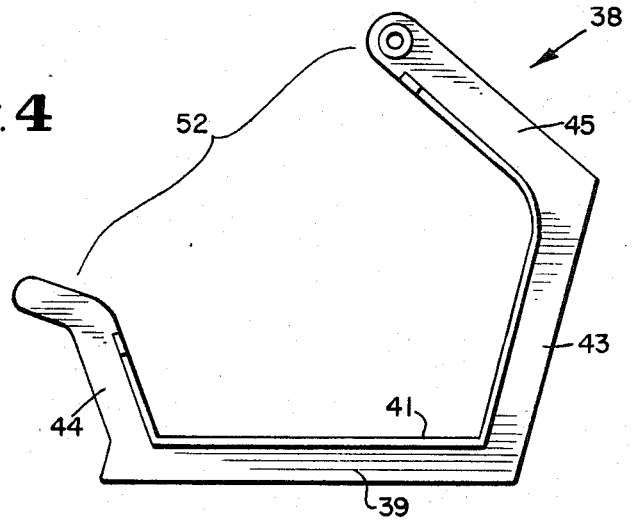
FIG. 4 is a side elevational view of the board bundle cradle constructed in accordance with the present invention.
Figure 6:
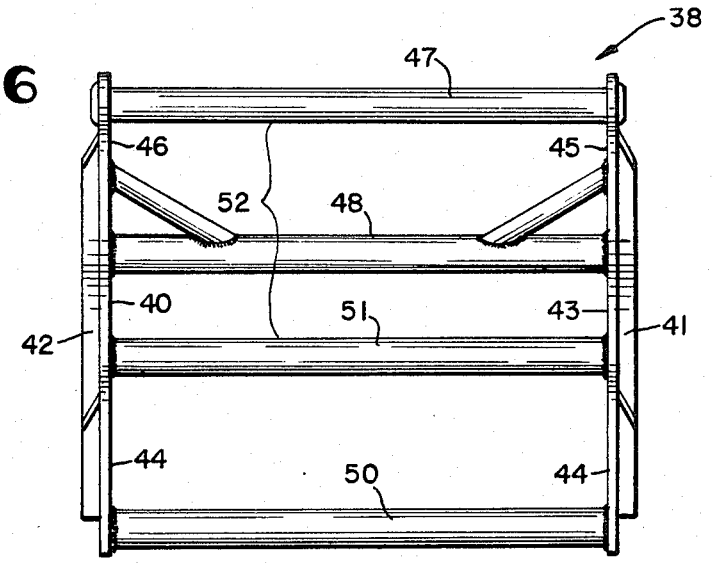
FIG. 6 is a front perspective view of the board bundle cradle of FIGS. 4 and 5.

The work carrier 25 has a pair of front and rear attaching pads 32,33 pivoted at 34. It also has a frame 36 which may be rotated up to 106° horizontally relative to the pivot 31 at the end of the dip stick 30 by cylinder and ram unit 37. As shown best in FIGS. 2 and 3 work carrier 25 has an upturned hook 35 upon which is hung the board bundle cradle 38 which carries the board bundle.

The board road board bundle cradle 38 has a pair of spaced apart end frames 39,40 each frame having a base member 41,42 adapted to receive and support a bundle of boards to be laid into a board road. A major and a minor board bundle containment members 43,44 upstand from each end of each base member. An upper forwardly inclined member 45,46 extends from the upper portion of each major support member 43. Tubular spacer means 47,48,49,50 and 51 between said spaced apart end frames 39,40 rigidly secure the end frames 39,40 together in an all welded construction. The portion lying between the spacer 47 and the spacer 51 carried by the upper free end of the minor board bundle containment member 44 defines the loading mouth 52 of the cradle 38 through which a bundle of boards to be laid are introduced to the base members 41, 42 of each end frame 39,40. Carried by the horizontally rotatable work carrier 25 and being engagable with the spacer 47 at the upwardly forwardly inclined member of each end frame 39,40 is a cylinder and ram unit 37 connected through the hook 35 to rotate the cradle 38 containing a board bundle alternately ninety degrees for presenting the boards for laying both longitudinally and transversely of the direction of the board road to be laid.

What I claim is:

1. An apparatus for laying board roads for use with the free end of a dip stick having a pivoted work carrier at its free end which has a horizontally rotatable work carrier comprising a board bundle cradle hook adapted to be carried by said work carrier, being of U-shape having upwardly turned flat portions spaced apart and having laterally spaced side edges, and a board bundle cradle comprising a pair of spaced apart end frames secured together by a plurality of tubular spacers, each of said end frames having a base member adapted to receive and support a bundle of boards to be laid into a board road, a major and minor board bundle containment member upstanding from each end base member, an upper forwardly inclined member extending from the upper portion of each major support member, the portion lying between said upwardly forwardly inclined member and the upper free end of said minor board bundle containment member defining the mouth of the cradle through which a bundle of boards to be laid are introduced to and withdrawn from said cradle, the spacer between the upwardly forwardly inclined members being adapted to be carried in the U-shape flat member of said hook carried by said horizontally rotatable work carrier for rotating the cradle containing a board bundle alternately ninety degrees for presenting the boards for withdrawl from said cradle and laying both longitudinally and transversely of the direction of the board road to be laid.

* * * * *